US005085325A

United States Patent [19]

Jones et al.

[11] Patent Number: 5,085,325

[45] Date of Patent: Feb. 4, 1992

[54] COLOR SORTING SYSTEM AND METHOD

[75] Inventors: Clarence S. Jones, Los Altos, Calif.; Arthur W. Coolidge, White City; Dennis Cavin, deceased, late of Medford, both of Oreg., by Nan Hai Cavin, legal representative; Norman L. Betts, Sunnyvale; Jeffrey M. Moser, Oakland, both of Calif.; Kenneth J. McGarvey, Central Point, Oreg.

[73] Assignee: Simco/Ramic Corporation, Medford, Oreg.

[21] Appl. No.: 415,056

[22] Filed: Sep. 29, 1989

Related U.S. Application Data

[63] Continuation-in-part of Ser. No. 165,490, Mar. 8, 1988, abandoned.

[51] Int. Cl.[5] ..... B07C 5/342

[52] U.S. Cl. ..... 209/580; 209/939; 364/526; 382/17

[58] Field of Search ..... 209/576, 577, 580–582, 209/587, 939; 364/526; 356/23, 402, 406, 407, 425; 382/17

[56] References Cited

U.S. PATENT DOCUMENTS

| | | | |
|---|---|---|---|
| Re. 33,357 | 9/1990 | Randall | 358/106 |
| 2,933,613 | 4/1960 | Powers . | |
| 3,664,397 | 5/1972 | Raye et al. . | |
| 3,750,883 | 8/1973 | Irving et al. | 209/111.6 |
| 3,781,554 | 12/1973 | Krivoshiev et al. | 250/226 |
| 3,867,039 | 2/1975 | Nelson | 356/178 |
| 3,944,819 | 3/1976 | Sherwood | 250/226 |
| 3,980,181 | 9/1976 | Hoover et al. | 209/582 X |
| 4,057,352 | 11/1977 | Babb | 356/178 |
| 4,095,696 | 6/1978 | Sherwood | 209/581 X |
| 4,105,123 | 8/1978 | Irving et al. | 209/580 X |
| 4,120,402 | 10/1978 | Swanson | 209/580 X |
| 4,132,314 | 1/1979 | von Beckman et al. | 209/565 |
| 4,134,498 | 1/1979 | Jones et al. | 209/564 |
| 4,143,770 | 3/1979 | Grimmell et al. | 209/580 X |
| 4,146,135 | 3/1979 | Sarkar et al. | 209/580 |
| 4,186,836 | 2/1980 | Wassmer et al. | 209/565 |
| 4,203,522 | 5/1980 | Fraenkel et al. | 209/558 |
| 4,204,950 | 5/1980 | Burford, Jr. | 209/588 |

(List continued on next page.)

FOREIGN PATENT DOCUMENTS

| | | | |
|---|---|---|---|
| 0025284 | 3/1981 | European Pat. Off. | 209/576 |
| 0111877 | 6/1984 | European Pat. Off. | 209/580 |
| 0122653 | 10/1984 | European Pat. Off. | 209/587 |
| 0194148 | 9/1986 | European Pat. Off. | 209/580 |
| 0214287 | 10/1984 | Fed. Rep. of Germany | 209/581 |
| 62-279875 | 12/1987 | Japan | 209/580 |
| 63-100354 | 5/1988 | Japan | 209/576 |

OTHER PUBLICATIONS

"Inspecting The Impossible", James N. Wagner, Food Engineering, Jun. 1983.

"A Need and Method For Nonuniformity Correction in Solid State Image Sensor", Setoru C. Tanaka, PREprint of paper presented to SPIE conference on Focal Plane Methodologies, Aug. 24–26, 1982, in San Diego, Calif.

"CCD Line-Scan Cameras Models CCD1100, CCD1300, CCD1400", Jan. 1978, Fairchild Camera and Instrument Corporation.

*Primary Examiner*—Michael S. Huppert
*Assistant Examiner*—Edward M. Wacyra
*Attorney, Agent, or Firm*—Stoel Rives Boley Jones & Grey

[57] ABSTRACT

Color sorting system and method which are particularly suitable for sorting fruits and vegetables. The objects to be sorted are scanned with a color video camera, and the signals from the camera are digitized and utilized to address a look up table. The look up table is preloaded to provide reject data at those addresses for colors to be rejected. Several techniques for loading the look up table are disclosed. Then, on an online basis, the successive images address the look up table and the reject data is analyzed to drive appropriate reject apparatus. In one embodiment, the data from the look up table is applied to a spatial filter, and objects are rejected only if they have a certain number or sequence of unacceptable colors.

31 Claims, 10 Drawing Sheets

U.S. PATENT DOCUMENTS

| | | | |
|---|---|---|---|
| 4,207,985 | 6/1980 | Lockett et al. | 209/564 |
| 4,235,342 | 11/1980 | Braham | 209/581 X |
| 4,246,098 | 1/1981 | Conway et al. | 209/558 |
| 4,255,242 | 9/1980 | Lane | 356/407 |
| 4,278,538 | 7/1981 | Lawrence et al. | 209/581 X |
| 4,281,933 | 8/1981 | Houston et al. | 356/425 |
| 4,308,959 | 1/1982 | Hoover et al. | 209/563 |
| 4,352,430 | 10/1982 | Maier et al. | 209/581 X |
| 4,369,886 | 1/1983 | Lane et al. | 209/564 |
| 4,379,636 | 4/1983 | Yoshida | 356/407 |
| 4,488,245 | 12/1984 | Dalke et al. | 364/526 |
| 4,513,868 | 4/1985 | Culling et al. | 209/581 |
| 4,515,275 | 5/1985 | Mills et al. | 209/580 X |
| 4,576,071 | 3/1986 | Rayment | 83/76.8 |
| 4,687,107 | 8/1987 | Brown et al. | 209/556 |
| 4,738,175 | 4/1988 | Little et al. | 83/76.8 |
| 4,807,762 | 2/1989 | Illy et al. | 209/580 |

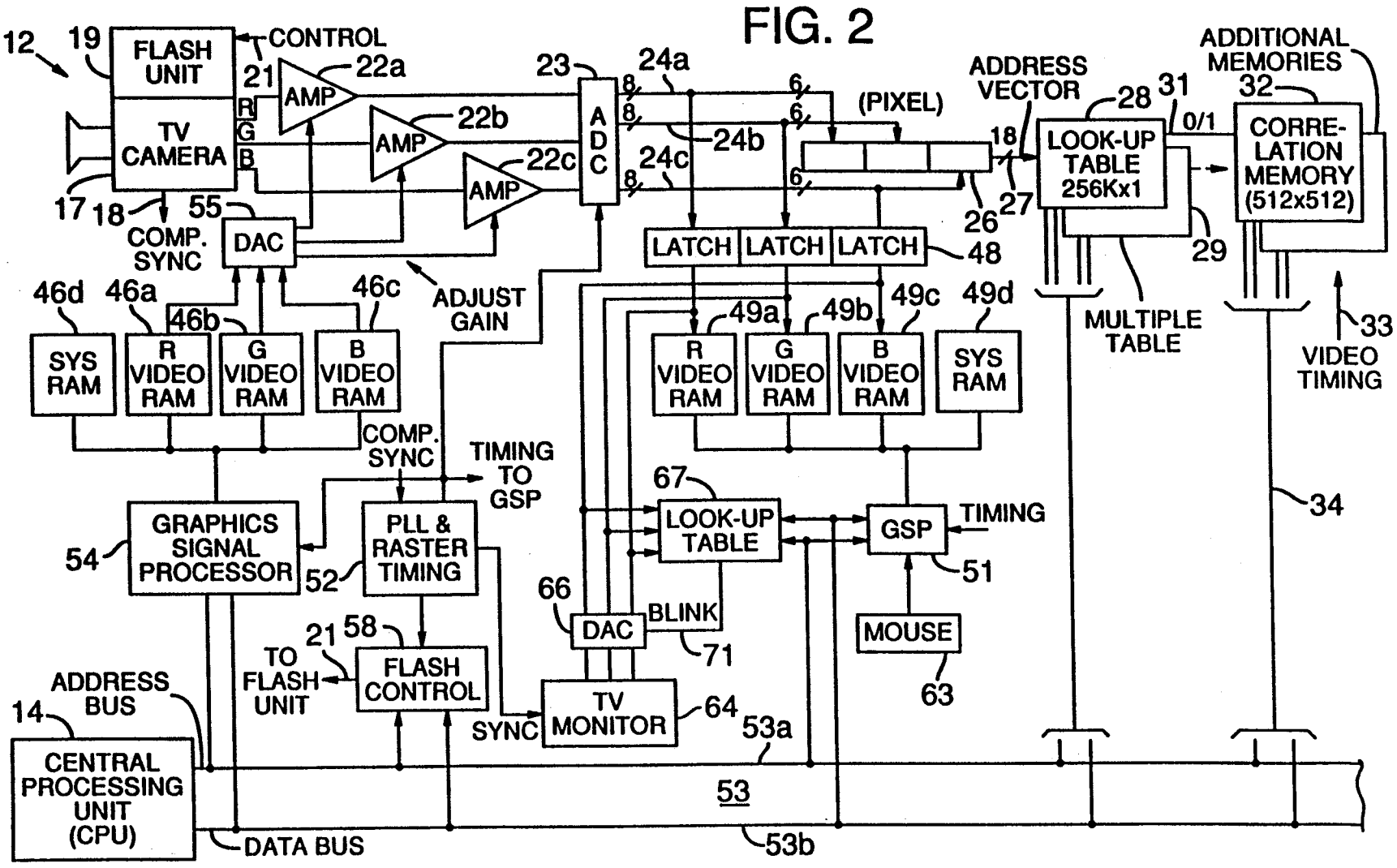
FIG. 2
ADDITIONAL MEMORIES
32
CORRE-LATION MEMORY (512x512)
33
VIDEO TIMING
34
0/1
31
28
LOOK-UP TABLE 256Kx1
29
MULTIPLE TABLE
ADDRESS VECTOR
18
27
26
(PIXEL)
48
LATCH
LATCH
LATCH
49d
SYS RAM
49c
B VIDEO RAM
49b
G VIDEO RAM
49a
R VIDEO RAM
TIMING
51
GSP
MOUSE
63
6
24a
24b
24c
8
23
A D C
22c
AMP
22b
AMP
22a
AMP
CONTROL
21
R
G
B
FLASH UNIT
TV CAMERA
19
17
18
12
55
DAC
COMP. SYNC
46c
B VIDEO RAM
46b
G VIDEO RAM
46a
R VIDEO RAM
46d
SYS RAM
ADJUST GAIN
TIMING TO GSP
COMP. SYNC
PLL & RASTER TIMING
52
GRAPHICS SIGNAL PROCESSOR
54
LOOK-UP TABLE
67
BLINK
71
DAC
66
TV MONITOR
64
SYNC
FLASH CONTROL
58
21
TO FLASH UNIT
53a
53
53b
DATA BUS
ADDRESS BUS
14
CENTRAL PROCESSING UNIT (CPU)

74

| DAC OUT | WH | BL | — |
|---|---|---|---|
| WHITE | H | L | L |
| BLACK | L | H | L |
| TIME | 1/4 | 1/4 | 1/2 |

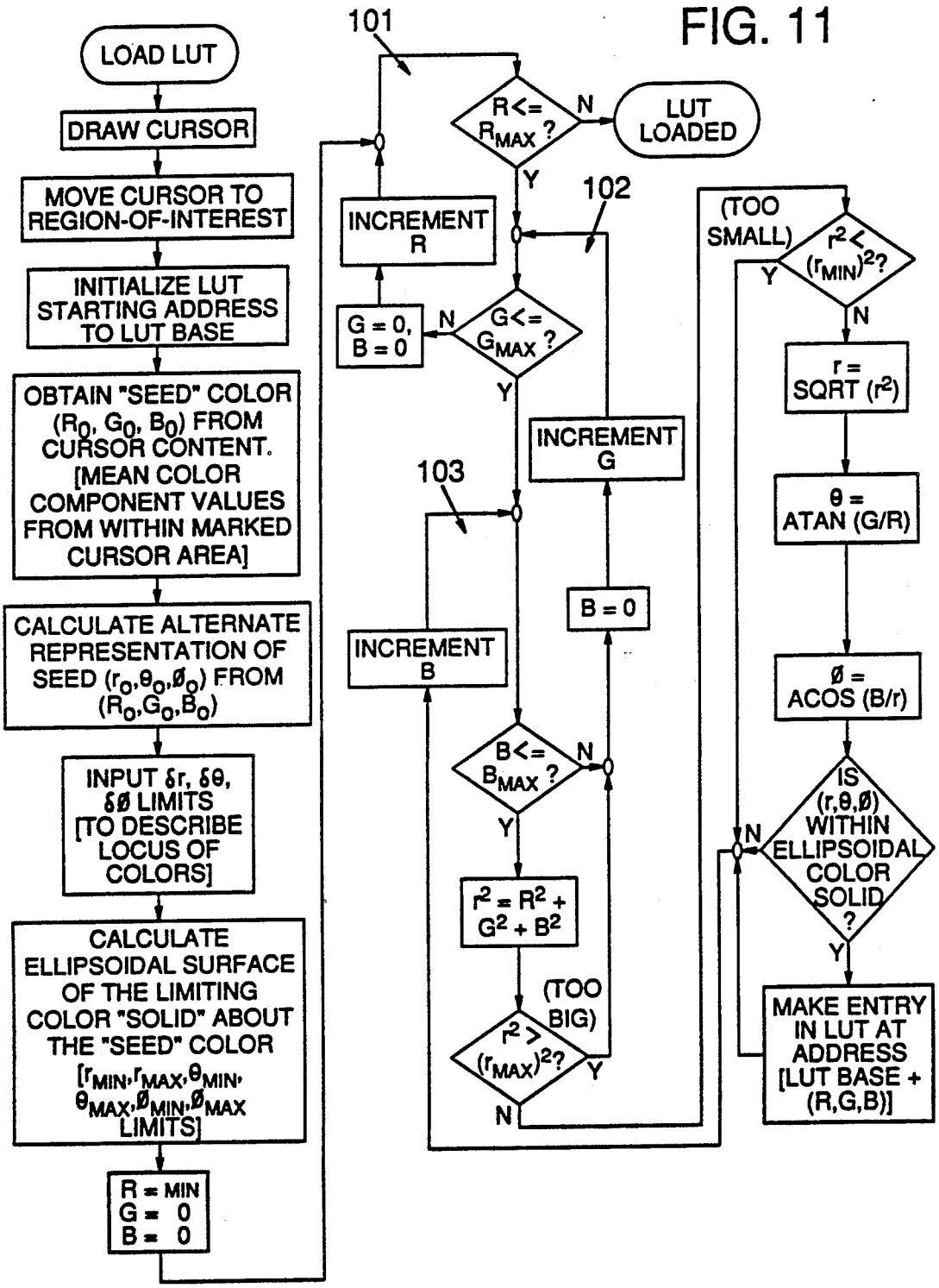
FIG. 11
LOAD LUT
DRAW CURSOR
MOVE CURSOR TO REGION-OF-INTEREST
INITIALIZE LUT STARTING ADDRESS TO LUT BASE
OBTAIN "SEED" COLOR ($R_0$, $G_0$, $B_0$) FROM CURSOR CONTENT. [MEAN COLOR COMPONENT VALUES FROM WITHIN MARKED CURSOR AREA]
CALCULATE ALTERNATE REPRESENTATION OF SEED ($r_0$,$\theta_0$,$\emptyset_0$) FROM ($R_0$,$G_0$,$B_0$)
INPUT $\delta r$, $\delta\theta$, $\delta\emptyset$ LIMITS [TO DESCRIBE LOCUS OF COLORS]
CALCULATE ELLIPSOIDAL SURFACE OF THE LIMITING COLOR "SOLID" ABOUT THE "SEED" COLOR [$r_{MIN}$,$r_{MAX}$,$\theta_{MIN}$, $\theta_{MAX}$,$\emptyset_{MIN}$,$\emptyset_{MAX}$ LIMITS]
R = MIN
G = 0
B = 0
101
R<= $R_{MAX}$ ?
N
LUT LOADED
Y
INCREMENT R
102
G = 0, B = 0
N
G<= $G_{MAX}$ ?
Y
INCREMENT G
103
B = 0
INCREMENT B
B<= $B_{MAX}$ ?
N
Y
$r^2 = R^2 + G^2 + B^2$
(TOO BIG)
$r^2 > (r_{MAX})^2$?
Y
N
(TOO SMALL)
$r^2 < (r_{MIN})^2$?
Y
N
r = SQRT ($r^2$)
$\theta$ = ATAN (G/R)
$\emptyset$ = ACOS (B/r)
IS ($r$,$\theta$,$\emptyset$) WITHIN ELLIPSOIDAL COLOR SOLID ?
N
Y
MAKE ENTRY IN LUT AT ADDRESS [LUT BASE + (R,G,B)]

COLOR SORTING SYSTEM AND METHOD

This is a continuation-in-part of U.S. Ser. No. 165,490, filed Mar. 8, 1988 in the names of Clarence S. Jones, Arthur W. Coolidge, Dennis Cavin and Norman L. Betts, and now abandoned.

The present invention is directed to a color sorting system and method, and more specifically to a system applicable to sorting items on a moving conveyor belt.

BACKGROUND OF THE INVENTION

It is well known how to provide sorting systems for sorting out defective fruits and vegetables as they are being moved on a conveyor belt. Such systems might typically include a scanning camera, which on a line by line basis, senses an objectionable variation in shade and then through an integration process, determines whether or not this item or portion of item should be eliminated or sorted. Many times these systems must be backed up by a manual means where the vision of an actual person is utilized.

With respect to sorting on the basis of color variations, this has been thought to be so complicated that there are no practical techniques available. The major difficulty in this field is, of course, processing of pixel information on an online basis and in a reliable and error-free manner. In other words, when sorting or rejecting undesirable items, it is uneconomical to either oversort (rejecting good items) or undersort (allowing objectionable items to pass).

OBJECT AND SUMMARY OF THE INVENTION

It is therefore a general object of the present invention to provide an improved color sorting system and method.

In accordance with the above object, there is provided apparatus for sorting moving items on a conveyor belt having a plurality of color values comprising a look up table with addressable memory locations corresponding to color values with data stored at each of the locations indicating an item has acceptable or rejectable color values. Color camera means are provided for capturing an image of items on the conveyor belt. Means are provided for addressing the look up table with color values of the image, and the items are accepted or rejected in accordance with the data read out of the look up table. Several techniques for loading the look up table are provided, and in one embodiment a spatial filter causes items to be rejected only if they have a certain number or sequence of unacceptable colors.

BRIEF DESCRIPTION OF THE DRAWINGS

FIG. 2 is an overall block diagram of the electrical components embodied in the present invention.

FIG. 11 is a flow chart illustrating one method of loading a look up table utilizing the spherical coordinates of FIG. 10.

DETAILED DESCRIPTION

Figure 1:
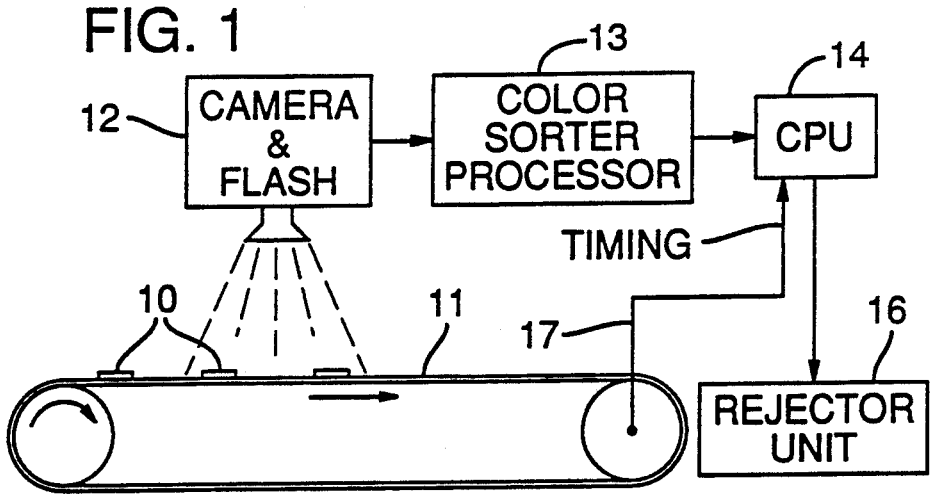
FIG. 1 is a block diagram of items on a conveyor belt being sorted by the apparatus and method of the present invention.

The sorting apparatus of the present invention has one preferred use in sorting moving items 10 on a conveyor belt 11, which for example, may be fruits or vegetables. A camera and flash unit 12 allows for multiple images of the items or products on the moving belt to be captured, processed by a color sorter processor 13, which is in general controlled by a central processor unit or minicomputer 14, to operate a rejector unit 16. Timing as to the location of the item 10 on the conveyor belt to provide for proper rejection is accomplished by the timing feedback 17, which for example, may be an output from a rotating pulse. In any case, such devices are well known in this field.

Multiple images may be recorded of the same object by successive flashes of the flash lamp. A snapshot is taken each time the flash lamp is flashed. This technique may be used to provide three different views or perspectives of an item on the conveyor belt to thus look at different sides or portions of the item for improved sorting.

Since all of the foregoing must be done on a real time basis—and with a conveyor moving at high speed—the color sorter processor 13 must receive the pictorial values from the camera and flash unit 12 and process them at, for example, a video rate. Typically, video camera 12 will be a charge coupled device which has a fast response time; it will provide red, blue and green separate outputs. The present invention is also applicable to black and white cameras which will provide gray scale values. These require somewhat less processing time with the same equipment.

While items on a moving conveyor belt have been shown, any type of succession of images can be sorted where a high speed processing of the image information is desired.

FIG. 2 is a detailed block diagram of the camera and flash unit 12, the color sorter processor 13 and its relationship to the central processing unit (CPU) 14. As discussed above, the specific TV camera may typically be a charge coupled device having red, green and blue outputs labeled respectively, R, G and B. In addition, the TV camera will provide a composite synchronization output at 18, which is well known in the art. The flash unit 19 may include a series of Xenon lamps, which are placed over the imaging plane to provide an essentially uniform light field. The control input 21 actuates the flash unit at desired times.

The R, G and B outputs of camera 17 are passed through multiplying amplifiers 22a–22c and these analog outputs then are converted to digital 8-bit words by analog to digital converter 23 on the lines 24a through 24c, respectively. The amplifiers 22 thus allow an online gain adjustment on a pixel to pixel (picture element) basis, as the raster scans are made by the TV camera 17.

Next, the six most significant bits of the output lines from analog to digital converter 23 are grouped to form a single address word in a register 26 to form on line 27 an 18-bit address vector. This vector then addresses look up table 28 or additional look up tables 29 at an address as determined by the specific color value (or, for that matter, black and white or pictorial value) of the pixel being processed at that time. It should be emphasized that this pixel is just one piece of information in a line of a raster scan of the TV camera 17, and thus, such addressing and subsequent processing of the information must be done at a video rate. Thus, look up table 28 is effectively a 256K×1 memory where there is an address for every pixel element; this assumes a resolution of, for example, 512 lines of raster with each line containing 512 pixels. From a practical standpoint, table 28 could be course be made up of multiple memories, especially where multiple tables are desired.

Stored in look up table 28 is a bit having a value of either 0 or 1 for each pixel. This data is sequentially read out on the line 31 and stored in a corresponding correlation memory 32. Thus, the output of the look up table 28 corresponds on a 1 to 1 basis to the selected address and then the correlation memory under the control of a video timing input indicated at 33 and also its CPU link 34 effectively contains a representation of the original image taken by TV camera 17.

Figure 7:
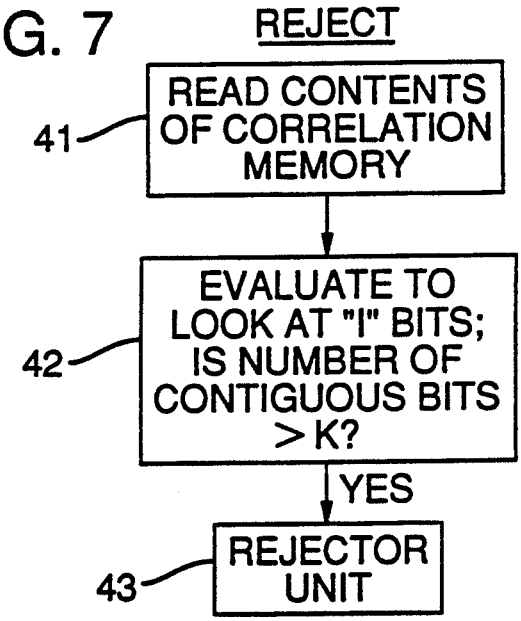
FIG. 7 is a flow chart illustrating a reject technique of the present invention.
Figure 8:
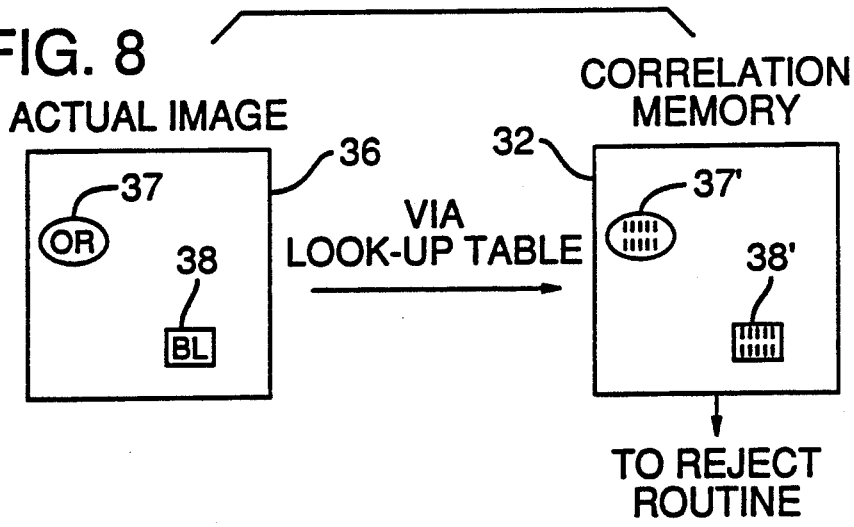
FIG. 8 is a representation of a memory showing implementation of the reject technique of FIG. 7.

FIG. 8 shows the foregoing where an actual typical image is indicated at 36, which may include a circular orange item at 37 and a square black item at 38. Assuming both of these colors are to be sorted out or rejected by the system, then the orange and black color values would be placed in the look up table, as implemented in the preferred embodiment of the invention, as binary "1s" stored as data in the look up table. Then when the table is addressed and data read out, in the correlation memory 32 groups of "1s" would effectively appear, as shown as 37' and 38'. Thus, this illustrates how the correlation memory on a online basis provides an electronic image of the snapshot taken by TV camera 17, the image containing data for use in sorting. FIG. 7 illustrates the sort or reject routine which is accomplished by a central processing unit which includes in step 41 reading the contents of the correlation memory and then, in step 42, evaluating the "1" bits to determine if the number of contiguous bits is greater than a predetermined constant K. If so, then these are effectively the undesired items 37 and 38 and in step 43, a rejector unit (see FIG. 1, unit 16) is activated.

Of course, for practical use for fruits or vegetables, rejector 16 might include a cutter for eliminating undersized portions and retaining the remainder of the item.

Thus, to summarize, the data in the look up tables would, in a normal color sorting application, have zeroes stored for the acceptable colors in a sample of items being surveyed and also for the belt color carrying the items. All other locations in the look up table memory 28 would be set to a "1." Therefore, anything that was not recognized as being a desirable product or the belt would be recognized as an undesirable item.

As schematically illustrated in FIG. 2, the correlation memory may consist of additional memories 32'. This would be useful when, for example, in examining fruit it is desired to sense a spoiled or "bad" spot on the fruit. Thus, if three different perspectives of the fruit are available as it moves along the conveyor belt, the capability of seeing a bad spot is tripled. In essence, the correlation memories are overlaid and then if any of the correlation memories shows a reject indication or function, the object is rejected or cut.

As discussed previously, the output amplifiers of the TV camera 17, 22a–22c, are adjustable in gain. This allows the amplitudes to be normalized to correct for optical problems, including variations in television camera lenses and nonuniformity of the lighting field. Uniformity in this system is important since the output of the analog to digital converter 23 is utilized as an address vector for the look up table 28. If this output varies due to lighting conditions or conditions within the television camera or lens, a different look up table address might be provided even though the same exact color was present in the image field on the conveyor belt Accordingly, the video RAMs 46a, 46b and 46c are provided, along with a system RAM 46d, the first three RAMs corresponding to the red, green and blue color channels of the TV camera 17. These memories have stored in them correction or scaling factors so that during the acquisition of a picture or snapshot, all the pixels (if the conveyor belt is blank) will have the same intensity. This is accomplished on a pixel by pixel online basis.

Figure 3:
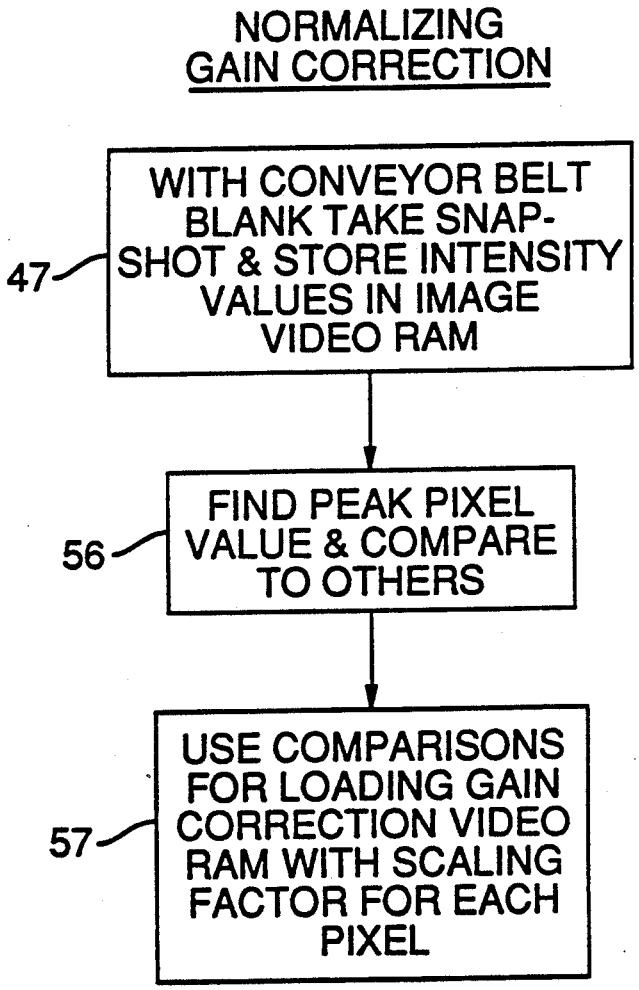
FIG. 3 is a flow chart showing a normalizing gain correction technique.

FIG. 3 is a flow chart showing the steps for normalizing gain correction. In step 47 with the conveyor belt blank a snapshot is taken of the belt and the intensity values resulting from this snapshot are stored in an image video RAM. Referring to FIG. 2, the output lines 24a–24c from analog to digital converter 23 are latched by the latches 48 and this digital image information is then stored in the respective red, green and blue video RAMs 49a–49c. A system RAM 49d is also provided which may be for black and white information or a composite of red, green and blue. Such video RAMs, of course, contain in effect an image of the raster scan of the TV camera 17 and is under the control of a graphics signal processor (GSP) 51, which receives timing from the composite sync output 18 of the camera. This timing is processed by a phase locked loop and raster timing unit 52. Pictorial information from the video RAMs 49 is transmitted through the bus lines 53, which include the address bus 53a and the data bus 53b, to another graphic signal processor 54, which directly drives the gain correction video RAMs 46. This GSP 54, as shown by step 56 in FIG. 3, finds the peak pixel value of this particular image and compares that value to the other pixel values. Then in step 57 the processor uses these comparisons for loading the gain correction video RAM 46 with a scaling factor for each pixel to in effect provide a uniform image.

Raster timing unit 52 also controls the flash control unit 58 with an output 21 which is the control input to flash unit 19.

The various outputs of the gain correction video RAMs 46 are converted to analog form by the digital to analog converter unit 55 to drive the analog amplifiers 22.

Before the color sorting system of the present invention is operational, look up table 28 and multiple tables 29 must of course first be loaded with the proper data.

In general, two different approaches to look up table loading may be taken. The first and most obvious approach is a theoretical one where color values are theoretically selected. The first approach being completely general, the look up table can be loaded with any computable number which, if it has a relationship to the output of the TV camera 17, will provide for effective sorting.

The second approach, illustrated in the preferred embodiment, is an empirical approach which utilizes the color values in actual samples or items on the conveyor belt to set up the look up table. And this approach also utilizes the gain correction technique discussed above.

Figure 4:
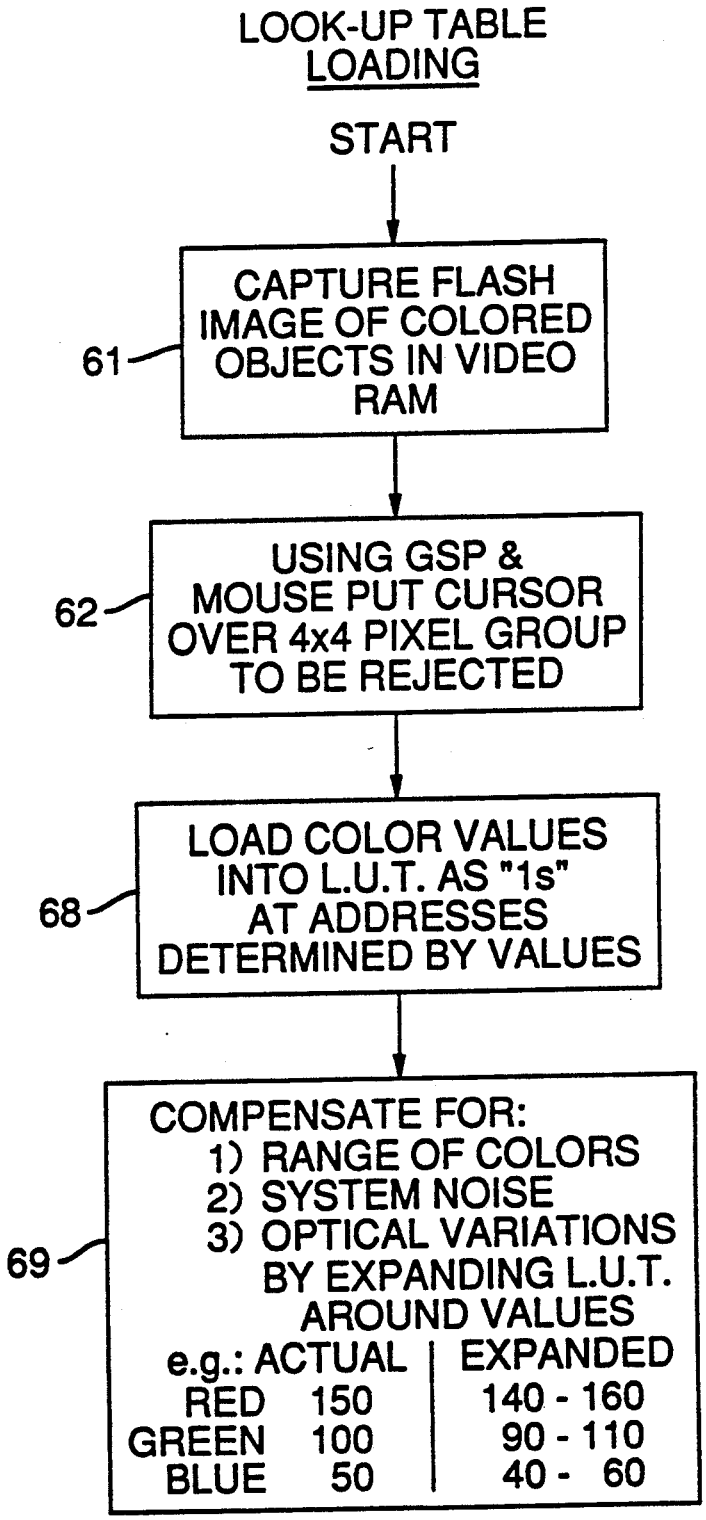
FIG. 4 is a flow chart showing a look up table loading technique.

In this approach the following sequence of events takes place: a flash image of various sample items on the conveyor belt is captured and placed in the image video RAMs 49*a*–49*c*. FIG. 4 illustrates the flow chart for such look up table loading and this first step is shown as step 61. Rather than capture merely a single image of the color objects, an alternative is several identical images with the images being averaged. Then, as shown by step 62, by use of graphic signal processor 51 and a mouse 63 (see FIG. 2), a cursor is placed over a 4×4 pixel group to be rejected, which would be seen on the TV monitor 64. This TV monitor is loaded from the same output lines from the latch 48 as the image RAMs 49. And the digital information is converted by digital to analog converter 66. Since the image on the TV monitor 64 corresponds exactly to that stored in the video RAMs 49, the pixels selected by the cursor may be read into the look up table 67 by the GSP 51. And these pixel values are, of course, placed as 1s. Table 67 would then be loaded into the look up table 28.

The foregoing is illustrated as step 68 in FIG. 4. In actuality, however, because of various non-uniformities in the system, the graphic signal processor 51, in conjunction with the central processing unit 14, provides certain compensations for the cursor indicated color values indicated in step 69. Here since in the case of natural products, there is a range of colors and also there is system noise and optical variations, the look up table value is expanded around the theoretically designated value. Such correction of, for example, optical variations, must be made even though the lighting may be uniform and the gain control memory has provided an adjustable gain. This may be because the surface structure of items being looked at is reflected in a specular manner and light is diffused away from the sample in various ways to produce variations in a perceived color, as seen by the system.

Thus, as illustrated in step 69, typical color values of red, green and blue are given and then an expansion band has been indicated. Thus, the band around each value allows the system to effectively sort on those values.

Another alternative technique is that rather than utilize a single image of objects to be sorted, several images can be taken and these values averaged before a set of data points is generated. Or again, another alternative procedure is that the spread of the multiple images might provide a spread in values to be placed in the look up table.

To assist the operator in using the empirical method for setting up color values in the look up table, a so-called "blinking" technique can be used which displays the image of the colored objects on TV monitor 64 and effectively visually blinks those color values which have been defined as unacceptable or are to be rejected.

Figure 5:
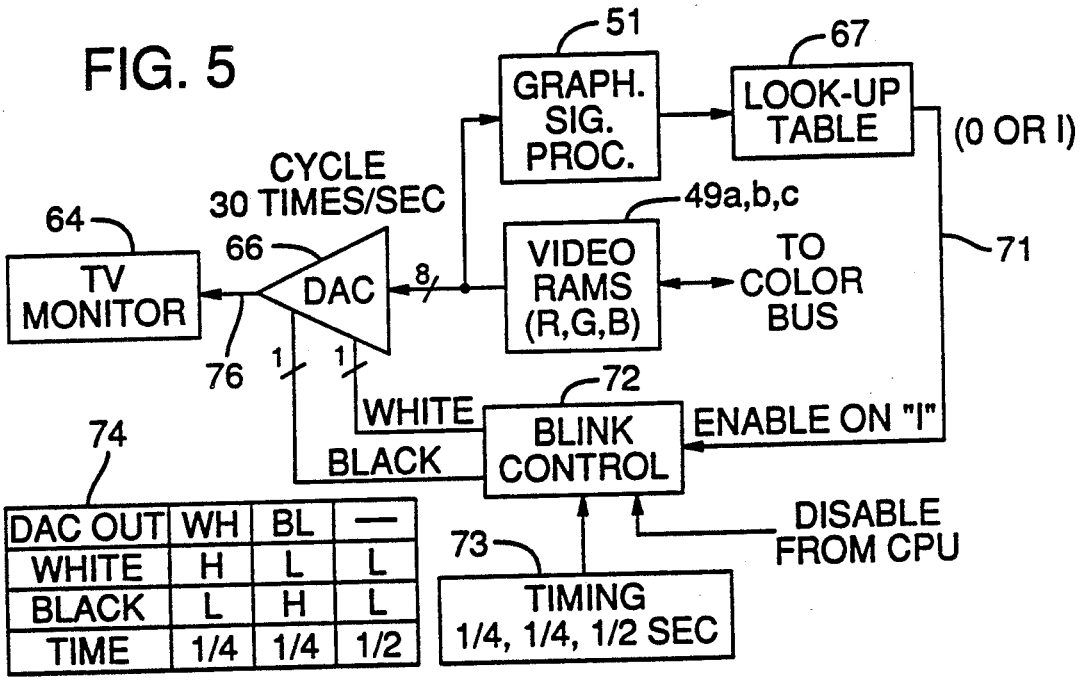
FIG. 5 is a block diagram illustrating apparatus used for a blinking technique of the present invention.

FIG. 5 is an expanded block diagram which includes many of the components of FIG. 2, including the video RAMs 49*a*–49*c*, look up table 67, graphic signal processor 51 and the digital to analog converter 66, which drives TV monitor 64. A composite video RAM 49 may be utilized or only one color, for example, red. When the image is read out of the video RAM 49, it provides an image on TV monitor 64 via the digital to analog converter 66 and at the same time, through the graphic signal processor 51, drives the look up table 67 which has had the proper data stored in it as described above. The output of look up table 67 on line 71 is effectively a blink line when the data is a binary 1 to indicate undesirable or reject type data. This enables a blink control unit 72 (see FIG. 5) which under the control of a timing unit 73, provides a blinking of the pixel or pixels to be rejected. Blink control unit 72 responds to timing unit 73 in the manner as illustrated by the table 74. This table shows a DAC out which is the input 76 to TV monitor 64. The output line 76 of DAC 66 may be either white, black or the actual color value provided by video RAM 49. There are white and black input control lines to the digital to analog converter 66 and when either of these is activated, that will provide the particular color output on line 76. Timing unit 73 provides that the white output lasts ¼ of a second, the black output ¼ of a second and the true color ½ second. Since this occurs on a cycle time of the frame rate of 30 times per second, the user will then see approximately eight frames of pixels which are white, eight frames which are black and then the remaining 14 frames with the actual color.

Figure 6:
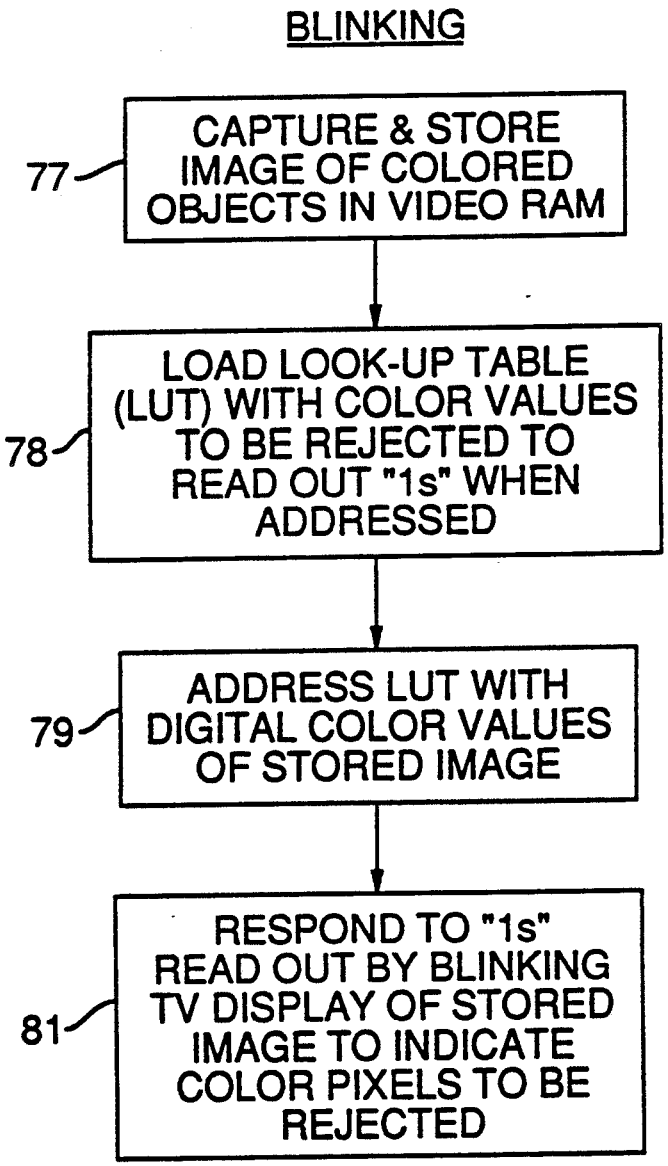
FIG. 6 is a flow chart illustrating the above blinking technique.

The flow chart of FIG. 6 more clearly illustrates the foregoing where in step 77 the image of the particular objects is captured in video RAM 49. After the look up table has been appropriately loaded, as shown in step 78, the look up table 67 is addressed as shown in step 79, with the digital color value of the stored image and in step 81, the "1s" (which are the undesired values) are responded to by blinking the TV display to indicate the color pixels to be rejected. Thus, the foregoing technique can be used by the operator for modifying the look up table values (for example, the range or band of values) as desired.

Figure 9:
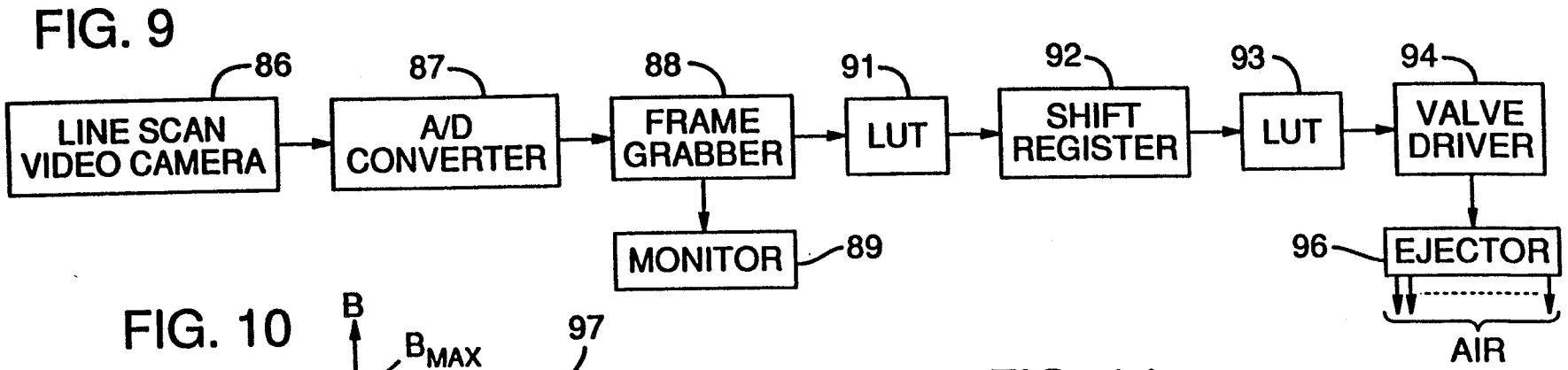
FIG. 9 is a simplified block diagram of another embodiment of a color sorting system according to the invention.

The embodiment of FIG. 9 includes a line scan color video camera 86 which has an array of photosensors such as charge coupled devices which receive light from a plurality of discrete photo sites located on a line extending in a direction generally perpendicular to the movement of a conveyor belt (not shown). In one present embodiment, each scan line contains 864 pixels, with three photo sites (red, green and blue) per pixel, but any suitable number of pixels and photo sites can be provided. With the belt moving in a direction generally perpendicular to the scan line, successive readings of the photosensors are taken to provide data for different scan lines. The data is processed in frames which can consist of any desired number of scan lines. To get a general idea of what is on the belt, for example, a picture having 768 lines per frame can be employed, whereas during a sorting operation, a lesser number of lines might be utilized, e.g. 42 lines per frame. If desired, frames having as few as only one scan line can be employed.

The output signals from the video camera are normalized and applied to an analog-to-digital converter 87 where, as in the embodiment of FIG. 2, the six most significant bits for each of the three colors (red, green and blue) in each pixel are combined to form an 18-bit word.

The output of A/D converter 87 is applied to a frame grabber 88 which includes means for storing the digitized color information for each pixel, a graphics signal processor (GSP) and a look up table (LUT). A video monitor 89 receives the video information from the frame grabber and provides a video display of whatever is being scanned by the camera on a frame by frame basis.

As in the previous embodiment, the look up table is organized by colors and has a separate memory location or cell for each color which is recognized by the system. At each memory location, a bit is stored to indicate whether the particular color is acceptable or not. A 0 indicates that the color is acceptable, and a 1 indicates that it is not. The 18-bit word containing the color information for each successive pixel is applied to the look up table as an address vector, and the output of the look up table is a one-bit word which indicates whether the color of the particular pixel is acceptable.

As in the embodiment of FIG. 2, the graphics signal processor permits the color information to be expanded in its application to the look up table to compensate for variations in color and other factors such as system noise and variations in the optical system.

The information in the look up table in the frame grabber is copied into another look up table 91 which can be one of any desired number of such tables in the system.

The output of look up table 91 is applied to the input of a shift register 92, and the output of the shift register is applied to the address lines of a third look up table 93. Shift register 92 and look up table 93 form a spatial filter which causes an object on the conveyor belt to be rejected only if it has a certain number or sequence of unacceptable colors. The shift register converts the single bit output stream from look up table 91 to a series of 16-bit words which are applied to look up table 93 as address vectors. Table 93 can, for example, be set up to provide an output signal if at least a given number of bits in the address word from table 91 are 1s. Table 93 can also be set up to provide an output only if the 1s occur in a predetermined sequence in the address word.

The output signal from look up table 93 is applied to a valve driver 94 which controls the discharge of air through a plurality of nozzles in an ejector unit 96. The air jets from these nozzles divert objects identified as having defects from the normal path of delivery by the belt to a reject area.

The operation of the system of FIG. 9 is controlled by a microprocessor or other suitable processor which has been omitted from the drawing for clarity and ease of illustration. The processor interfaces with the other elements in a conventional manner which should be apparent to those skilled in the art.

Figure 10:
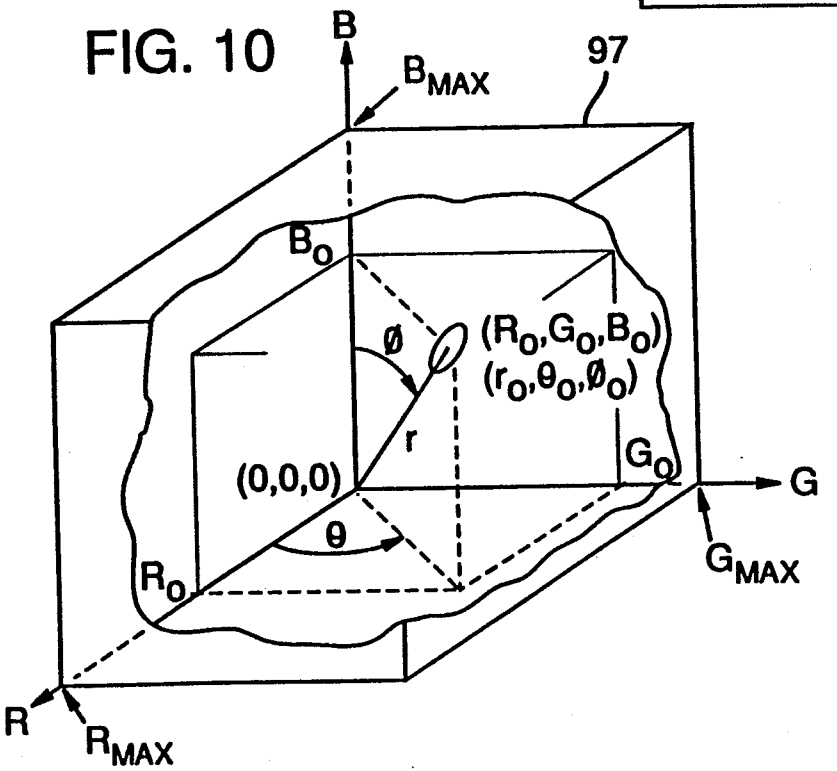
FIG. 10 is a three dimensional graphical representation showing the use of spherical coordinates to represent different colors.

One method of loading a look up table such as look up table 67 of FIG. 2 or 91 of FIG. 9 is illustrated in FIGS. 10 and 11. In these figures, the red, green and blue components of the colors which are recognized by the system range in value from 0 to $R_{MAX}$, $G_{MAX}$ and $B_{MAX}$, respectively. In FIG. 10, these components are plotted along the axes of a three dimensional Cartesian coordinate system, and the colors which are recognized by the system fall within a cube 97 which has one corner at the origin and three of its edges extending along the R, G and B axes between the values 0 and $R_{MAX}$, $G_{MAX}$ and $B_{MAX}$, respectively. In this system, black is located at the point (0,0,0), and white is located at ($R_{MAX}$,$G_{MAX}$,$B_{MAX}$).

Any color can be represented either by its Cartesian coordinates R,G,B, or by spherical coordinates $\phi$,$\Theta$,r, where r is a vector extending from the origin to the point, $\phi$ is the angle between the B axis and the vector r, and $\Theta$ is the angle between the R axis and the component of the vector r in the R-G plane.

The use of spherical coordinates overcomes an inherent limitation of the Cartesian system where different intensities of the same color have different coordinates (e.g., (2,2,2), (3,3,3), etc.), and may not be recognized as being the same color. With spherical coordinates, different intensities of the same color have different values of r, but they all have the same values of $\phi$ and $\Theta$. Thus, by monitoring $\phi$ and $\Theta$, it is possible to identify colors which are the same even though they vary in intensity.

Referring now to FIG. 11, a cursor is drawn on the screen of monitor 89 and moved to an area of interest on the screen to sample the color found in that area. The cursor is drawn and moved in a conventional manner utilizing a mouse or other suitable input device. The cursor can be of any desired size, e.g. 3×3 or 4×4 pixels, and in some applications it may be as small as a single pixel.

The loading of the look up table is the process by which the system learns which colors are to be accepted and/or which colors are to be rejected. The area selected by the cursor can, therefore, contain either a color which is to be accepted or a color which is to be rejected. In the example which is illustrated in FIG. 11, it is assumed that the table is initially loaded with all 1s and that 0s are to be written into the table for colors in a range surrounding the mean value of the color in the area sampled by the cursor. This range provides a degree of tolerance for variations in color as well as other factors such as system noise and variations in the system optics. In the particular example, the look up table is a positive table, and the cursor is positioned over a color which is to be accepted. For a negative look up table, the table would be initialized to all-0s, the cursor would be positioned over a color which is to be rejected, and 1s would be written into the table for colors in the range surrounding the selected color.

Returning now to the example of FIG. 11, once the contents of the look up table have been set initially to 1s, the starting address for the look up table is initialized to a suitable starting address LUT BASE.

A "seed" color ($R_0$,$G_0$,$B_0$) is then obtained from the area within the cursor by finding the mean values of the red, green and blue color components within the area, and the spherical coordinates ($\phi_0$,$\Theta_0$,$r_0$) of the seed color are calculated from the Cartesian coordinates.

Values of $\delta r$, $\delta\phi$ and $\delta\Theta$ are input to define a range of colors which will be accepted in addition to the actual seed color. These values are added to and subtracted from the corresponding coordinates of the seed color to provide the limiting values $r_{MIN}$, $r_{MAX}$, $\phi_{MIN}$, $\phi_{MAX}$, $\Theta_{MIN}$, and $\Theta_{MAX}$. With the spherical coordinates, the range of colors to be accepted falls within an ellipsoid which is centered about the seed color. The shape of the ellipsoid is dependent upon the relative amounts of dithering in the values of r, $\phi$ and $\Theta$, i.e. in the relative values of $\delta r$, $\delta\phi$ and $\delta\Theta$.

After the range of acceptable colors has been defined, R is set to an initial value, or lower limit, R=MIN, and G and B are set to 0. The initial value, or lower limit, of R is determined by calculating the smallest value of R in the range of acceptable colors from $R_0$, $\delta r$, $\delta\phi$ and $\delta\Theta$, then subtracting a small number of units (e.g., 2) from this value to provide a margin of safety. Setting the lower limit of R in this manner reduces the number of subsequent calculations which might otherwise be made on colors which are outside the range of interest.

Once the initializing steps have been completed, a series of three loops are executed to generate all of the possible combinations of R, G and B in the range of acceptable colors. These loops include an outermost loop 101 in which the value of R is incremented, an intermediate loop 102 in which the value of G is incremented, and an innermost loop 103 in which the value of B is incremented.

During each pass through loop 103, the current value of $r^2$ is calculated from the current values of $R^2$, $G^2$ and $B^2$, and the value of $r^2$ is compared with $(r_{MAX})^2$ and $(r_{MIN})^2$ as a prequalifying test for values of R, G and B which appear to be within the range of acceptance. If $r^2$ is between $(r_{MAX})^2$ and $(r_{MIN})^2$, then r is calculated by taking the square root of $r^2$, and $\Theta$ and $\phi$ are calculated from the relationships $\Theta=\arctan(G/R)$ and $\phi=\arccos(B/r)$. The latter two calculations are relatively time consuming, and the $r^2$ tests avoid the need to make these calculations for values of R, G and B which are clearly outside the acceptable range.

Once the values of r, $\phi$ and $\Theta$ have been calculated, they are tested to determine whether the color corresponding to them is within the acceptable range. This is done by comparing $\phi$ with $\phi_{MIN}$ and $\phi_{MAX}$, and $\Theta$ with $\Theta_{MIN}$ and $\Theta_{MAX}$. It is not necessary to compare r with $r_{MIN}$ and $r_{MAX}$ since $r^2$ has already been found to be between $(r_{MAX})^2$ and $(r_{MIN})^2$. If the values of r, $\phi$ and $\Theta$ are all within the limits of the acceptable color range, a 0 is entered into the look up table for this color. This entry is made at the address LUT BASE+(R,G,B). After the entry is made in the look up table, the program returns to the loops until entries have been made for all of the colors within the acceptable range.

The manner in which the loops are executed is briefly as follows. On the initial pass through the loops with R at its lower limiting value and G and B set to 0, all three of the loops are bypassed since the tests $R<=R_{MAX}$, $G<=G_{MAX}$ and $B<=B_{MAX}$ are all satisfied and $r^2$ is not greater than $(r_{MAX})^2$. Since $r^2$ is smaller than $(r_{MIN})^2$, B is incremented, and the innermost loop 103 executed again. This process continues until B has been incremented to the point that $r^2$ is no longer smaller than $(r_{MIN})^2$, at which point the values of r, $\Theta$ and $\phi$ are calculated, and these values are tested to determine whether the color defined by them is within the acceptable range. If it is, an entry is made in the look up table. Whether or not an entry is made, B is once again incremented, loop 103 is executed, and new values of r, $\Theta$ and $\phi$ are calculated and tested. This process continues until B has been incremented to the point that B is greater than $B_{MAX}$ or $r^2$ is greater than $(r_{MAX})^2$.

Once B is greater than $B_{MAX}$ or $r^2$ is greater than $(r_{MAX})^2$, B is set to 0, G is incremented, and loop 102 is executed. As long as G is not greater than $G_{MAX}$, the program returns to loop 103, and this loop is executed until B is once again greater than $B_{MAX}$ or $r^2$ is once again greater than $(r_{MAX})^2$. At that point, G is incremented again, and this process continues until the B loop (loop 103) has been executed for all legal values of G, i.e., until G is greater than $G_{MAX}$.

Once G is greater than $G_{MAX}$, both B and G are reset to 0, and R is incremented. The B and G loops are then executed for all values of B and all values of G with this value of R, following which the value of R is incremented again. This process continues until all legal values of R have been used, i.e. until R is greater than $R_{MAX}$, at which point the loading of the look up table is complete.

Figure 14:
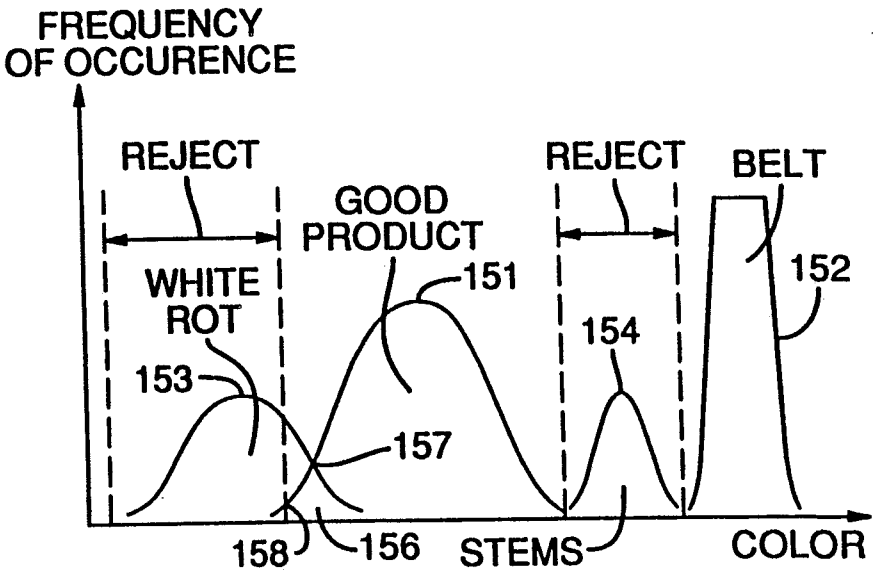
FIG. 14 is a graphical representation further illustrating the use of the method of FIG. 12.
Figure 12:
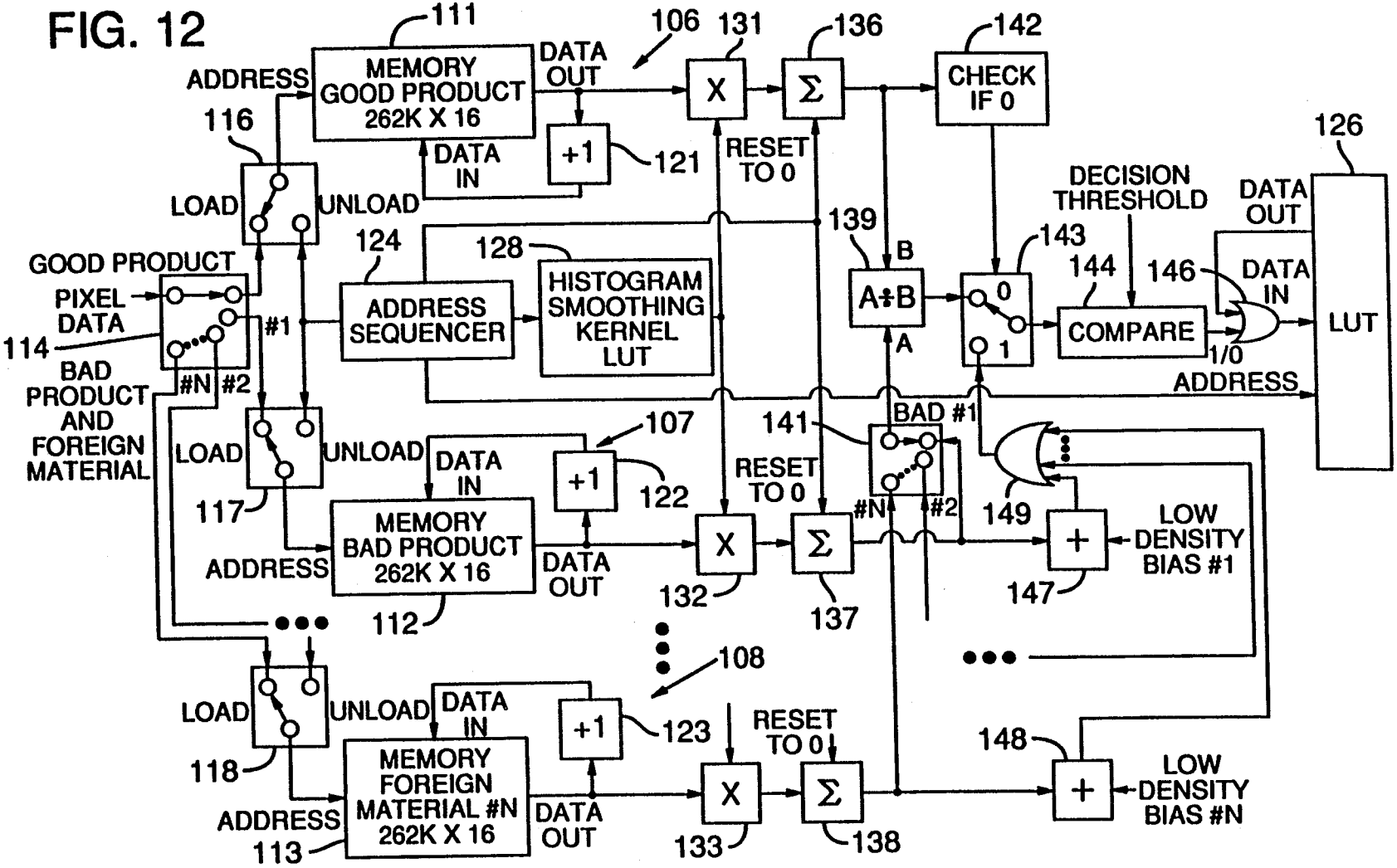
FIG. 12 is a functional block diagram of another method of loading a look up table in a color sorting system according to the invention.
Figure 13:
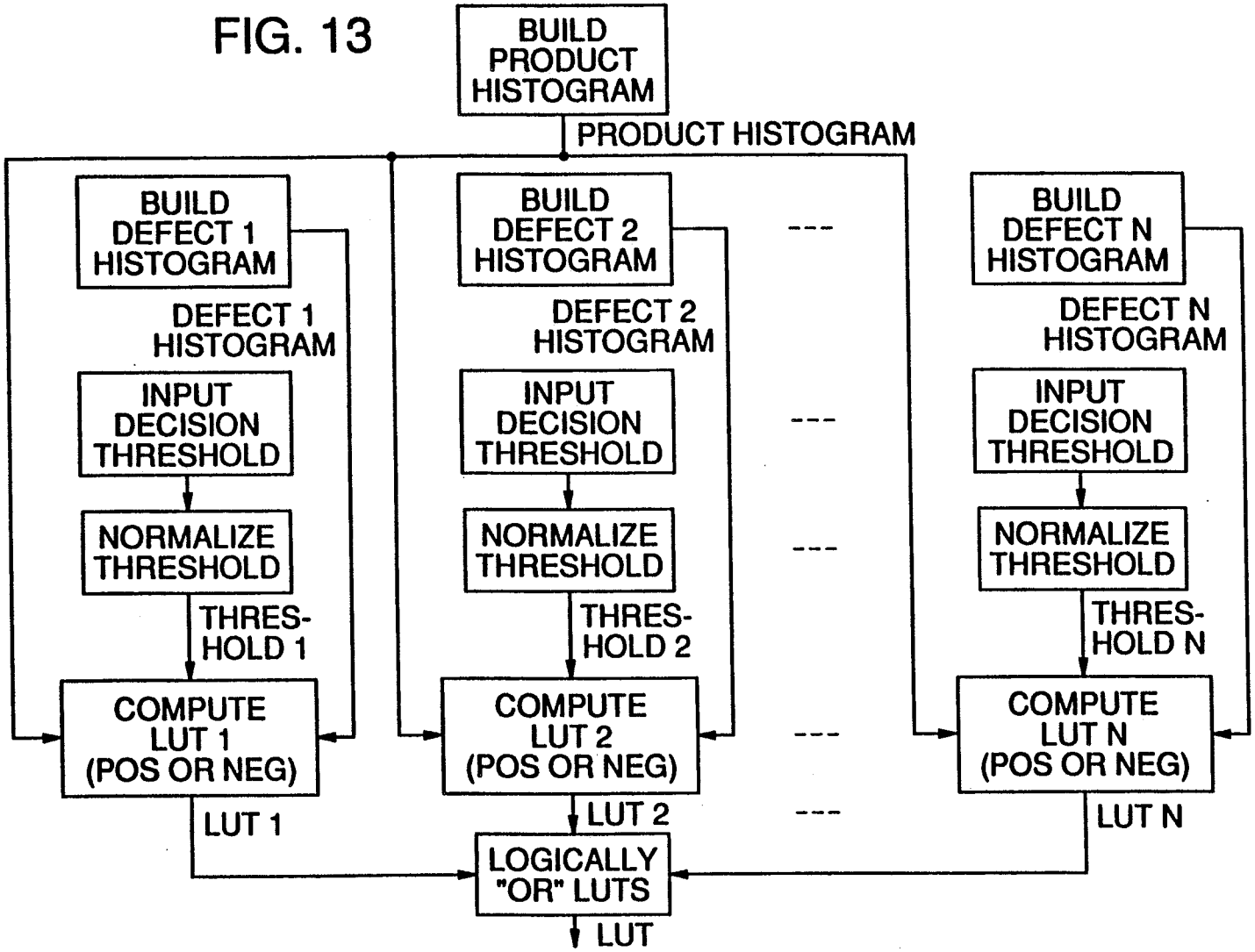
FIG. 13 is a data flow diagram for the method of FIG. 12.

Another technique for loading a look up table is illustrated in FIGS. 12–14. This techniques utilizes histograms and statistical analysis to simplify the process of determining acceptable and rejectable colors of products which are difficult to sort. Such products may, for example, have two or more rejectable colors among a fairly wide range of acceptable colors. One example of such a product is green beans. In green beans, a wide range of green from light to dark is usually acceptable, while lighter yellow, white and black spots are to be rejected.

Histograms are generated for good products as well as defects or other objects, e.g. foreign materials, to be rejected, and the histograms are combined to generate the look up table. Each histogram comprises a table in which the number of times each color occurs in the product, defect and/or other object is recorded. Data from a plurality of frames can be added together to provide large statistical samples of the colors which occur on good products, the colors which occur on defective products, and the colors which occur on other materials to be rejected.

Using this approach, both positive and negative look up tables can be created. For a positive look up table, data is taken only for the defects or other features to be detected, and for a negative look up table, data is taken for everything but the features to be detected, e.g. everything which is not a good product. Otherwise stated, for a positive look up table only defects are "shot", and for a negative look up table everything else is "shot".

Each type of look up table has certain advantages, and in some applications the two types of tables can be combined advantageously. A negative look up table is generally easier to create, and since it "shoots" at anything which is not a good product, it can detect all kinds of product defects and foreign materials which do not share colors with a good product. A positive look up table can be set up for specific defects and can provide "fine tuning" for those defects.

In the functional block diagram of FIG. 12, separate channels 106–108 are shown for good product, bad product (defects) and foreign material. While three such channels are shown in this particular embodiment, any desired number of channels can be provided in a given system, depending upon the number of defects and foreign materials to be sorted out.

Each of the channels includes a memory 111–113 in which a histogram for the product, defect, or foreign material is created. In the embodiment illustrated, each memory has 262,000 addressable locations of 16 bits each, and each histogram can therefore count up to $2^{16}$ occurrences of each of over 260,000 different colors.

During construction of the histograms, pixel data for a given product, defect or foreign material is applied to the address lines of the appropriate memory by an input switch 114 and LOAD/UNLOAD switches 116–118, which can be implemented in software. Each time a given memory location is addressed, the count at that address is incremented by 1, as illustrated by the incrementers 121–123 connected between the data outputs and data inputs of the memories. When all of the pixel data for a given sample has been input, the number stored in each memory location indicates the frequency or number of occurrences of the corresponding pixel value or color in the sample.

An address sequencer 124 is provided for unloading data from the histogram memories and for loading data into the look up table 126. During the unloading operation, switches 116–118 are set to the UNLOAD positions, and the address signals from the address sequencer are applied to the address lines of the memories.

Means is included for smoothing the histogram data from memories 111–113. This means includes a smoothing kernel 128 comprising a 3-dimensional (one for each of the three colors red, green and blue) convolution which performs a multidimensional lowpass filtering function. The kernel includes a look up table which is addressed by the address sequencer in synchronization with the histogram memories to provide the correct filter coefficients for the histogram data. The histogram data and the filter coefficients are combined in multipliers 131–133 and summation blocks 136–138, and the summation blocks are reset to 0, or initialized, before the data from each histogram location is smoothed.

The smoothed histogram data for a defect or foreign material is divided by the smoothed histogram data for a good product in a divider 139, with the data for the various defects and foreign materials being selectively applied to the divider by a switch 141.

Means 142 is provided for checking the good product data to verify that it is not zero since division by zero does not give a meaningful result. As long as the good product data is not zero, the output of the divider passes through a switch 143 to a comparator 144 where it is compared with a threshold which is set to minimize the rejection of good products and the acceptance of defects and foreign materials. The threshold level can be set, for example, by displaying a good product on the video monitor and blinking any pixels containing a color to be rejected. The threshold value is then increased until any blinking within the good product stops. The output of the comparator is either a 1 or a 0, depending upon whether the output of the divider exceeds the threshold level.

The output of the comparator is loaded into the proper memory location of look up table 126 through an OR gate 146. The data output of the look up table is applied to a second input of the OR gate to combine the results of discriminating a good product from a plurality defects or foreign materials in the look up table.

In the event that the good product data is zero, the defect or foreign material data is applied to the input of comparator 144 by switch 143. When the good product data is zero, the defect and foreign material data is also usually relatively small, and before it is applied to the comparator, it is offset by a bias to alter the effective threshold level for this low density situation. Thus, the smoothed data from summation networks 137, 138 is passed through biasing networks 147, 148 which increase the level of the data. This helps in mitigating errors due to noise in the data which can occur at low density levels. The data from the biasing networks is applied to the inputs of an OR gate 149, and the output of this gate is applied to comparator 144 by switch 143.

When the data for all of the defects and foreign materials has been processed, the data in the look up table will reflect the combined results of entire process. This look up table is then used in making sorting decisions in the manner disclosed above.

FIG. 13 illustrates the data flow in the system of FIG. 12 for a good product and N defects. As illustrated in this figure, separate histograms are constructed for the good product and for each of the defects. An input decision threshold is input and normalized for each of the defects, and look up tables LUT 1, LUT 2, . . . ,LUT N are computed from the product histogram and the normalized thresholds and histograms for the respective defects. These look up tables are combined in a logical OR function to provide the final look up table LUT.

Each of the look up tables LUT 1, LUT 2, . . . ,LUT N can be either a positive look up table or a negative look up table, and both positive and negative tables can be combined, if desired. A positive look up table is created by executing the following code for each color (R,G,B):

If ((DEFECT HIST [R,B,G]/ PROD HIST [R,G,B])>NORM THRESH) then POSITIVE COLOR LUT [R,G,B]=1;
Else POSITIVE COLOR LUT [R,G,B]=0.

Similarly, a negative look up table is created by executing the following code for each color (R,G,B):

If ((PRODUCT HIST [R,B,G]/ DEFECT HIST [R,G,B])>NORM THRESH) then NEGATIVE COLOR LUT [R,G,B]=0;
Else NEGATIVE COLOR LUT [R,G,B]=1.

Utilizing the system of FIG. 12, a negative look up table can be created very simply and quickly by "shooting" one or more frames which contain both good product and defect colors, then eliminating the product by looking only at colors which do not occur more than a certain number of times. This is done quite easily by loading a histogram memory with the number of occurrences at which the cut-off is desired and comparing this threshold data with the product and defect data. The resulting look up table may not be as finely tuned as ones created in a more calculated manner, but it is adequate for many purposes.

FIG. 14 illustrates the use of the statistically assisted system of FIG. 12 in sorting green beans on a dark green conveyor belt. Initially, only beans which are free of defects, i.e. good product, are placed on the belt, and a histogram is constructed. This histogram has the distribution represented by the curves 151, 152 for the beans and the belt, respectively. Next only samples of defects (white rot and stems) are placed on the belt, and another histogram is constructed. This histogram has the distribution represented by the curves 153, 154 for the white rot and the stems, and in addition it has the distribution represented by the curve 152 for the belt.

When the two histograms are superimposed, there is some overlap in the area 156 between the good product and the white rot because of some common colors in the two. There is no overlap, however, between the beans and the stems since the stems are substantially darker than the beans.

At the point 157 where curves 151 and 153 cross, the ratio of good product to defect is 1:1, and if the threshold were set at this level, some good product would be rejected. A better point to set the threshold is where the ratio is about 4:1, as indicated by the reference numeral 158. With the threshold set at this level, all colors under the curve 153 from the point where the ratio is 4:1 will be rejected, but very little product will be rejected. The stems will all be rejected since there is no good product in this area, and the dark green belt will not appear as a defect since it is present in both histograms and the ratio for it is always 1:1.

Although the invention has been disclosed in conjunction with its preferred use in sorting fruits or vegetables, generally the sorting of a succession of any type of images or other data can be achieved. In addition to the use of television cameras, other inputs such as radar or acoustic sensors can be utilized. All that is required is synchronizing the data in such a way that the images may be combined on a pixel by pixel basis. In addition to sorting in the preferred embodiment on color values, shades of grey or black and white images may be similarly used which can utilize the processing speed of the present invention. In addition to sorting on color, as for example, illustrated by the grouping of contiguous is in the correlation memory or the spatial filter, this same information contains shape data and such shape information can be utilized for sorting.

It is apparent from the foregoing that a new and improved color sorting system and method have been provided. While only certain presently preferred embodiments have been described in detail, as will be apparent to those familiar with the art, certain changes and modifications can be made without departing from the scope of the invention as defined by the following claims.

We claim:

1. Apparatus for processing moving items having a plurality of color values, comprising:

a look up table with addressable memory locations corresponding to said color values and with an indicating datum stored at each of said locations indicating an item or a portion thereof has acceptable or rejectable color values;

color camera means for capturing an image of said moving items;

normalizing means for providing normalized color values of said image from said color camera means;

addressing means using said normalized color values for addressing said look up table;

color value expanding means for providing around a central color value a range of color values having said indicating datum stored in corresponding look up table locations to compensate for any one of system noise, a range of color variation, or optical variations; and memory means responsive to said stored datum in said look up table locations corresponding to the captured image of the moving items for storing processing data used to process said moving items.

2. Apparatus as in claim 1 in which said normalizing means includes analog gain adjusting means for normalizing said color values.

3. Apparatus as in claim 1 where said memory means includes a memory matrix with at least the same number of elements as there are in the captured image.

4. Apparatus as in claim 1 where said color camera means includes flash illumination means for effectively stopping the motion of the image of said moving items.

5. Apparatus as in claim 1, including a secondary look up table for off line usage.

6. A method of real time image recognition of moving items having a plurality of color values for processing the items on the basis of color variations, comprising the following steps:

constructing a look up table having memory locations addressable by the color values of items or portions thereof to be processed, where each addressable memory location is stored with a datum indicating an item or a portion thereof has acceptable or rejectable color values;

capturing a color image of said moving items;

normalizing said color values of said captured color image and using said normalized color values to address said look up table;

expanding around a central color value a range of color values having said datum stored in corresponding look up table locations to compensate for any of system noise, a range of color variation, and optical variations; and reading out said datum from said look up table and determining which items or portions thereof are to be processed based on said acceptable or rejectable values as determined by said datum.

7. A method as in claim 6, where said normalization includes compensating for ambient conditions.

8. A method as in claim 6, where said normalization is also utilized in said step of constructing said look up table.

9. A method as in claim 7 where in said step of constructing said look up table, selected rejectable color values are placed on a color television monitor and blinked at a rate viewable by an observer.

10. A method of analyzing and processing moving items corresponding to images represented by rows of pixels, each pixel having a value, said method comprising the following steps:

capturing one of said images;

normalizing each pixel value of said one of said captured images;

designating pixels within said image, said pixels representing moving items, or portions thereof, and satisfying a criterion for processing said moving items;

expanding around the value of said designated pixels a range of pixel values to compensate for any one of system noise, a range of color variation, or optical variations;

storing a datum within a look up table at look up table locations addressed by said range of pixel values; and reading out said datum from said look up table locations and determining said processing of moving items or portions thereof, based on said criterion represented by said read out datum.

11. A method as in claim 10, including the step of digitizing each of said pixel values into a number, said number representing an address of said look up table.

12. A method as in claim 10, where said items move at a speed and where said images are taken at a rate dependent on the speed of said moving items and the digitization of the image occurs at a video pixel readout rate.

13. A method as in claim 10 where each pixel is converted into a number representing its color or black and white shade, said digital number representing an address vector for said look up table.

14. A method as in claim 10, where said look up table is constructed from a precalculated set of values derived from a previously measured set of pixel values.

15. A method as in claim 10 where said processing is accomplished by a predetermined algorithm relating to contiguous relationship of pixel data from said look up table.

16. Apparatus for processing moving items in accordance with color, comprising:

means for providing normalized color value signals corresponding to colors on the moving items, a first look up table having memory locations addressed by the normalized color value signals, each of said addressed locations having a stored datum indicating whether the colors to which the signals correspond are acceptable or not, a second look up table having addressable memory locations, each of which having accept/reject datum stored therein, logic means responsive to the output of the first look up table for directly addressing the memory locations of the second look up table, and means responsive to the addressed accept/reject datum from the second look up table for controlling the processing of the moving items.

17. The apparatus of claim 16 wherein the logic means for directly addressing the memory locations of the second look up table includes means for converting a serial stream of output data from the first look up table to multibit address signals for the second look up table.

18. A method of processing moving items in accordance with color, comprising the steps of:

storing accept/reject datum at addressable locations in first and second look up tables to indicate whether address signals applied to the look up tables represent acceptable colors, providing normalized color value signals corresponding to colors at a plurality of sites on the moving items, addressing the first look up table with the normalized color value signals to provide said first look up table datum as output signals which indicate whether the colors at the sites on the moving items are acceptable, addressing the second look up table in accordance with a group of the output signals to provide said second look up table datum of processing signals which indicate whether the group of output signals is acceptable, and controlling the processing of the items in accordance with the processing signals.

19. The method of claim 18 wherein the second look up table is addressed by converting a serial stream of output data from the first look up table to a multibit address signal, and applying the multibit address signal to the second look up table.

20. In apparatus for sorting items in accordance with color on a moving conveyor belt:

a. means for providing color value signals corresponding to colors at a plurality of sites on the conveyor belt;

b. a look up table having memory locations addressed by the color value signals;

c. means for loading the memory locations with data indicating whether the colors corresponding to the signals which address the locations are acceptable or not, said means comprising:

(1) means for representing a sample color as a point in a three dimensional coordinate system in which three predetermined colors are plotted along first, second and third mutually perpendicular axes;

(2) means for determining the spherical coordinates $r,\phi,\Theta$ of the sample color, where r is the length of a vector extending from the origin to the point representing the sample color, $\phi$ is the angle between the first axis and the vector, and $\Theta$ is the angle between the second axis and the component of the vector in the plane of the second and third axes;

(3) means for dithering the values of the spherical coordinates to define an ellipsoidal region in the coordinate system representing a range of colors centered generally about the sample color; and (4) means for storing data in the look up table at memory locations corresponding to the coordinates of points within the ellipsoidal region; and d. means responsive to data read from the look up table for controlling the course of the items on the conveyor belt.

21. The apparatus of claim 20 wherein the means for storing data in the look up table includes means for comparing the value of r for different points in the coordinate system with $r_{MIN}$ and $r_{MAX}$, where $r_{MIN}$ and $r_{MAX}$ are the minimum and maximum values of r in the ellipsoidal region, means for comparing the values of $\phi$ and $\Theta$ for a given point with the minimum and maximum values of $\phi$ and $\Theta$ in the ellipsoidal region if the value of r for the given point is between $r_{MIN}$ and $r_{MAX}$, and means for loading data into a memory location having an address corresponding to the coordinates of the given point if the values of r, $\phi$ and $\Theta$ for the point are between the minimum and maximum values of r, $\phi$ and $\Theta$ in the ellipsoidal region.

22. In a method for sorting items in accordance with color on a moving conveyor belt, the steps of:

a. providing color value signals corresponding to colors at a plurality of sites on the conveyor belt;

b. addressing memory locations in a look up table with the color value signals;

c. loading the memory locations with data indicating whether the colors corresponding to the signals which address the locations are acceptable or not, by the steps of:

(1) representing a sample color as a point in a three dimensional coordinate system in which three predetermined colors are plotted along first, second and third mutually perpendicular axes;

(2) determining the spherical coordinates $r,\phi,\Theta$ of the sample color, where r is the length of a vector extending from the origin to the point representing the sample color, $\phi$ is the angle between the first axis and the vector, and $\Theta$ is the angle between the second axis and the component of the vector in the plane of the second and third axes;

(3) dithering the values of the spherical coordinates to define an ellipsoidal region in the coordinate system representing a range of colors centered generally about the sample color; and (4) storing data in the look up table at memory locations corresponding to the coordinates of points within the ellipsoidal region; and d. controlling the course of the items on the conveyor belt in response to data read from the look up table.

23. The method of claim 22 wherein the data is stored in the look up table by comparing the value of r for different points in the coordinate system with $r_{MIN}$ and $r_{MAX}$, where $r_{MIN}$ and $r_{MAX}$ are the minimum and maximum values of r in the ellipsoidal region, comparing the values of $\phi$ and $\Theta$ for a given point with the minimum and maximum values of $\phi$ and $\Theta$ in the ellipsoidal region if the value of r for the given point is between $r_{MIN}$ and $r_{MAX}$, and loading data into a memory location having an address corresponding to the coordinates of the given point if the values of r, $\phi$ and $\Theta$ for the point are between the minimum and maximum values of r, $\phi$ and $\Theta$ in the ellipsoidal region.

24. Apparatus for processing moving items in accordance with color on said items, comprising:

a. means for providing normalized color value signals corresponding to colors at a plurality of sites on an acceptable item and at a plurality of sites on an item to be rejected;

b. means responsive to the normalized color value signals for accumulating the number of occurrences of individual colors in the acceptable item and accumulating the number of occurrences of individual colors in the item to be rejected;

c. means for comparing the number of occurrences of the individual colors in the acceptable item with the number of occurrences of the colors in the item to be rejected;

d. a look up table having addressable memory locations corresponding to the colors for storing accept/reject datum corresponding to the relative number of occurrences of the colors in the acceptable item and the number of occurrences of the colors in the item to be rejected;

e. means for addressing the look up table with normalized color value signals corresponding to colors at a plurality of sites on the moving items to read the corresponding accept/reject datum out of the look up table; and f. means responsive to the accept/reject datum from the look up table for controlling the processing of the items.

25. The apparatus of claim 24 wherein the means for accumulating the number of occurrences of the colors includes a first histogram memory with addressable memory locations corresponding to the colors for storing the number of occurrences of the colors for storing the number of occurrences of the colors in the acceptable item, a second histogram memory with addressable memory locations corresponding to the colors for storing the number of occurrences of the colors on the items to be rejected, and means for incrementing the accumulated number of occurrences in the first histogram memory locations in response to normalized color value signals of acceptable items, and means for incrementing the accumulated number of occurrences in the second histogram memory locations in response to normalized color value signals from items to be rejected.

26. The apparatus of claim 25 wherein the means for comparing the number of occurrences of the colors comprises means for applying address signals to the histogram memories to read the number of occurrences out of the memories, and means for dividing the number of occurrences from one of the memories by the number of occurrences from the other of said memories to provide color occurrence ratios.

27. The apparatus of claim 26 including means for comparing the color occurrence ratios with a threshold level to determine the accept/reject data to be stored in the look up table.

28. A method of processing moving items in accordance with color, comprising the steps of:

a. providing normalized color value signals corresponding to colors at a plurality of sites on an acceptable item and to colors at a plurality of sites on an item to be rejected;

b. accumulating the number of occurrences of individual colors in the acceptable item and accumulating the number of occurrences of individual colors in the item to be rejected in accordance with the normalized color value signals;

c. comparing the number of occurrences of the individual colors in the acceptable item with the number of occurrences of the individual colors in the item to be rejected;

d. storing accept/reject datum corresponding to the relative number of occurrences of the colors in the acceptable item and the number of occurrences of the colors in the item to be rejected in a look up table having addressable memory locations corresponding to the colors;

e. addressing the look up table with normalized color value signals corresponding to colors at a plurality of sites on the moving items to read the accept/reject datum out of the look up table; and f. controlling the processing of the moving items in accordance with the accept/reject datum from the look up table.

29. The method of claim 28 wherein the number of occurrences of the colors are accumulated by addressing memory locations in a first histogram memory in accordance with the normalized color value signals for the acceptable item, addressing memory locations in a second histogram memory in accordance with the normalized color value signals for the item to be rejected, and incrementing the accumulated number of occurrences in the first histogram memory locations in response to occurrences of the acceptable normalized color value signals and in the second histogram memory locations in response to occurrences of the normalized color value signals for an item to be rejected.

30. The method of claim 29 wherein the number of occurrences of the colors are compared by applying address signals to the histogram memories to read the number of occurrences out of the memories, and dividing the number of occurrences from one of the memories by the number of occurrences from the other of said memories to provide color occurrence ratios.

31. The method of claim 30 including the steps of comparing the color occurrence ratios with a threshold level to determine the accept/reject data to be stored in the look up table.

* * * * *